US008282802B2

(12) United States Patent
Sato et al.

(10) Patent No.: US 8,282,802 B2
(45) Date of Patent: Oct. 9, 2012

(54) WORK ELECTRODEPOSITION COATING METHOD AND ELECTRODEPOSITION COATING DEVICE

(75) Inventors: Kimihiro Sato, Toyoake (JP); Hidetoshi Kato, Anjo (JP); Masakazu Nakayama, Nisshin (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 517 days.

(21) Appl. No.: 12/670,372

(22) PCT Filed: Aug. 27, 2008

(86) PCT No.: PCT/JP2008/065240

§ 371 (c)(1),
(2), (4) Date: Jan. 22, 2010

(87) PCT Pub. No.: WO2009/028523

PCT Pub. Date: Mar. 5, 2009

(65) Prior Publication Data

US 2010/0200414 A1 Aug. 12, 2010

(30) Foreign Application Priority Data

Aug. 29, 2007 (JP) ..... 2007-222934

(51) Int. Cl.
*C25D 13/12* (2006.01)
*C25D 9/00* (2006.01)

(52) U.S. Cl. ..... 204/472; 204/623; 204/245; 205/317

(58) Field of Classification Search ..... 204/472, 204/623, 245; 205/317
See application file for complete search history.

(56) References Cited

FOREIGN PATENT DOCUMENTS

| | | | |
|---|---|---|---|
| JP | 06-063115 | B | 8/1994 |
| JP | 2002-521574 | A | 7/2002 |
| JP | 2004-298690 | A | 10/2004 |
| JP | 2005-139527 | A | 6/2005 |
| JP | 2006-152345 | A | 6/2006 |
| JP | 2006-527302 | A | 11/2006 |

*Primary Examiner* — Kishor Mayekar
(74) *Attorney, Agent, or Firm* — Kenyon & Kenyon LLP

(57) ABSTRACT

Provided with a work electrodeposition coating method for immersing a work in a paint in an electrodeposition tank provided with a first positive electrode for supplying a low voltage and a second positive electrode for supplying a high voltage to carry out electrodeposition coating of a work surface. The work electrodeposition coating method is comprised of a first step in which a first robot moves the work to a first table provided with an current collecting bar corresponding to the first positive electrode; a second step of connecting the work with the current collecting bar and supplies the work with the low voltage to carry out the electrodeposition coating; a third step in which a second robot provided with a negative electrode switches a connecting condition of the negative electrode connected with the work from the current collecting bar to an current collecting bar corresponding to the second positive electrode when the second robot chucks the work, and then carries out the electrodeposition coating while moving the work to a second table provided with an current collecting bar; and a fourth step of connecting the work to the current collecting bar and supplies the work with the high voltage to carry out the electrodeposition coating.

4 Claims, 1 Drawing Sheet

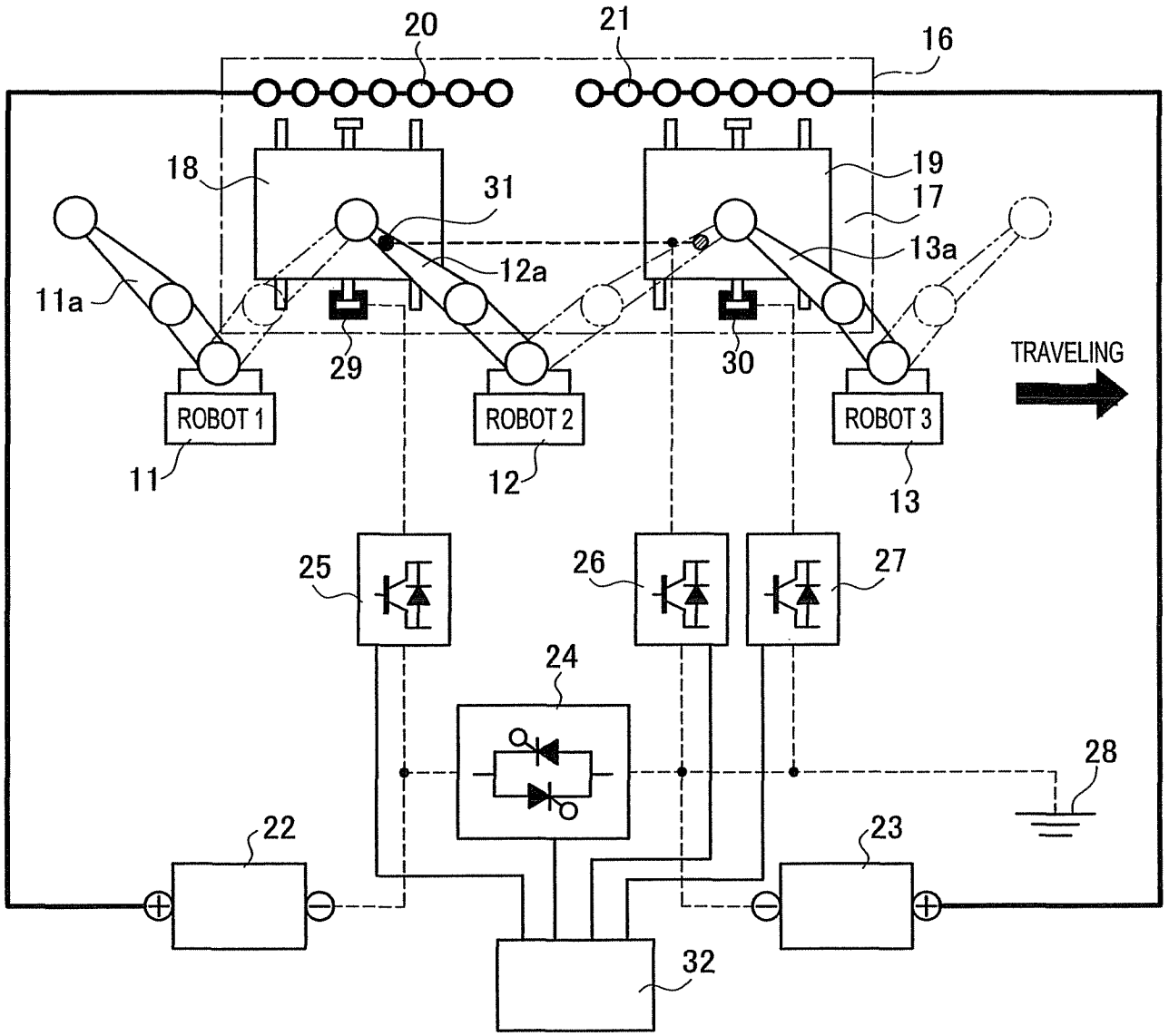
TRAVELING
ROBOT 1
ROBOT 2
ROBOT 3
11
11a
12
12a
13
13a
16
17
18
19
20
21
22
23
24
25
26
27
28
29
30
31
32

WORK ELECTRODEPOSITION COATING METHOD AND ELECTRODEPOSITION COATING DEVICE

This is a 371 national phase application of PCT/JP2008/065240 filed 27 Aug. 2008, claiming priority to Japanese Patent Application No. 2007-222934 filed 29 Aug. 2007, the contents of which are incorporated herein by reference.

TECHNICAL FIELD

The present invention relates to an electrodeposition coating method and an electrodeposition coating device and especially relates to an electrodeposition coating method and an electrodeposition device using a robot hand (arm).

BACKGROUND ART

Heretofore, coating on a work (a workpiece) of a vehicle has been done with a process of putting the work in a container, immersing the container with the work in an electrodeposition coating paint, and applying electricity between the work and electrodepositioning electrodes to deposit the paint on the work. Upon application of electricity, surface resistance of the work to be coated is low and therefore a large amount of electric current flows. As a result, a coating film is formed at a rapid pace, which causes a defect that coating thickness becomes uneven. A solution to this problem is to apply a low voltage at the start of the coating and then switch the voltage to a high voltage after a predetermined time has elapsed. For example, Patent Literature 1 discloses this technique. In the Patent Literature 1, a work is hung on a hanger and the hanger is conveyed. At the same time, the voltage to be applied to fixed electrodes is switched from low to high.

Citation List

Patent Literature

Patent Literature 1: JP 6(1994)-63115B

SUMMARY OF INVENTION

Technical Problem

However, the invention disclosed in Patent Literature 1 has the following problems.

Namely, since the work is hung on the hanger and conveyed, it is difficult to appropriately change inclination and others of the work. Further, it is hard to let the air accumulated in the work escape when the work is immersed in the electrodeposition liquid. If the air remains in the work, a portion contacting the air could only be insufficiently coated, resulting in uneven coating.

Furthermore, since the work is hung on the hanger and conveyed between the fixed electrodes, each portion of the work has a different distance from the electrodes depending on a shape of the work. Thereby, a thickness of the electrodeposition coating could be largely different from portion to portion. Therefore, some portions may have excessive thickness, resulting in cost increase.

The present invention has been made to solve the above problems and has a purpose to provide a work electrodeposition coating method and a work electrodeposition coating device which are able to easily make the air escape and to evenly coat every portion of a work.

Solution to Problem

To solve the above problems, the work electrodeposition coating method and the work electrodeposition device according to the present invention have the following configurations.

(1) According to one aspect of the invention, a work electrodeposition coating method performs a electrodeposition coating on a work surface by immersing a work in an electrodeposition liquid in an electrodeposition tank having a first positive electrode for supplying a low voltage and a second positive electrode for supplying a high voltage. The method comprises: a first step of causing a first robot to move the work to a first table provided with a first negative electrode corresponding to the first positive electrode; a second step of connecting the work to the first negative electrode and supplying the low voltage to the work to perform the electrodeposition coating; a third step of, when a second robot including a third negative electrode chucks the work, switching a connection condition of the third negative electrode connected to the work from the first negative electrode to a second negative electrode corresponding to the second positive electrode, and subsequently moving the work to a second table provided with the second negative electrode while performing the electrodeposition coating; and a fourth step of connecting the work to the second negative electrode and supplying the high voltage to perform the electrodeposition coating.

(2) In the work electrodeposition coating method according to (1), preferably, the third step includes causing a thyristor to bring the first negative electrode and the second negative electrode into conduction when the connection condition of the third negative electrode is to be switched from the first negative electrode to the second negative electrode.

(3) In the work electrodeposition coating method according to (1) or (2), preferably, the method comprises a fifth step of causing a third robot to disconnect the work from the second negative electrode and convey the work.

(4) According to another aspect of the invention, a work electrodeposition coating device performs an electrodeposition coating on a work surface by immersing a work in an electrodeposition liquid in an electrodeposition tank provided with a first positive electrode for supplying a low voltage and a second positive electrode for supplying a high voltage. The device includes: a first table on which the work is to be connected to a first negative electrode corresponding to the first positive electrode and supplied with the low voltage for performing the electrodeposition coating; a first robot for placing the work on the first table; a second robot provided with a third negative electrode and configured such that a connection condition of the third negative electrode connected to the work is switched from the first negative electrode to the second negative electrode corresponding to the second positive electrode when the second robot chucks the work, and subsequently the second robot moves the work to a second table provided with the second negative electrode while performing the electrodeposition coating; the second table for allowing the work to be connected to the second negative electrode and supplied with the high voltage for performing the electrodeposition coating; and a third robot for disconnecting the work from the second negative electrode and conveying the work.

Advantageous Effects of Invention

Operations and effects of the work electrodeposition coating method and the work electrodeposition coating device of the present invention having the above mentioned configurations are now explained.

The work electrodeposition coating method of the present invention comprises (a) a first step of causing a first robot to move a work to a first table provided with a first negative electrode corresponding to a first positive electrode. Therefore, when the work is immersed in the electrodeposition liquid, the work can be appropriately inclined, so that the air remained and adhered to a lower surface of the work can escape. This can prevent uneven coating caused by the air adhesion. Further, the work electrodeposition coating method of the present invention comprises (c) a third step of, when a second robot including a third negative electrode chucks the work, switching a connection condition of the third negative electrode connected to the work from the first negative electrode to a second negative electrode corresponding to a second positive electrode, and subsequently moving the work to a second table provided with the second negative electrode while performing the electrodeposition coating. Therefore, the work can be appropriately positioned with respect to the first positive electrode and the second positive electrode which are fixedly placed, so that each portion of the work can be equally positioned with respect to the positive electrodes. Hence, coating can be evenly made and a thickness of the coating can be uniformized, resulting in the paint saving.

Moreover, the work electrodeposition coating method of the present invention comprises the third step including causing a thyristor to bring the first negative electrode and the second negative electrode into conduction when the connection condition of the third negative electrode is to be switched from the first negative electrode to the second negative electrode. Therefore, even if the first negative electrode and the second negative electrode have an electric potential difference, the occurrence of a spark can be prevented.

Furthermore, the work electrodeposition coating method of the present invention comprises a fifth step of causing a third robot to disconnect the work from the second negative electrode and convey the work. Hence, all the conveyance of the work during the electrodeposition coating can be done by the robots, so that no additional conveyance means is needed, achieving the cost reduction in overall facilities.

BRIEF DESCRIPTION OF DRAWINGS

FIG. 1 shows an overall configuration of an electrodeposition coating device for performing an electrodeposition coating method.

REFERENCE SIGNS LIST

11 First robot
12 Second robot
13 Third robot
16 Electrodeposition tank
17 Paint
18 First table
19 Second table
20 First positive electrode
21 Second positive electrode
22, 23 Rectifier
24 Thyristor switch
29, 30 Current collecting bar
31 Negative electrode

DESCRIPTION OF EMBODIMENTS

A detailed description of a preferred embodiment of a work electrodeposition coating method of the present invention will now be given referring to the accompanying drawing.

FIG. 1 shows an overall configuration of an electrodeposition coating apparatus. In an electrodeposition tank 16, paint 17 is filled to almost eighty percent of a tank capacity. In the electrodeposition tank 16, a first table 18 and a second table 19 are fixedly placed. The first table 18 is provided with a first current collecting bar 29. The second table 19 is provided with a second current collecting bar 30. A plurality of cylindrical columnar first positive electrodes 20 are fixedly placed facing the first table 18 and arranged toward the second table. A plurality of cylindrical columnar second positive electrodes 21 are fixedly placed facing the second table 19 and arranged toward the first table.

Between the first table 18 and the second table 19, a second robot 12 is installed at the same distance from the first table 18 and the second table 19. A first robot 11 is installed in a position facing a left end of the electrodeposition tank 16. A third robot 13 is installed in a position facing a right end of the electrodeposition tank 16. The first robot 11, the second robot 12, and the third robot 13 are arranged in an almost straight line.

Each of the first robot 11, the second robot 12, and the third robot 13 has 6 degrees of freedom and is able to freely move a work to an arbitrary position and inclination.

A positive side of a rectifier 22 serving as a low-voltage direct current (DC) power source is connected to the first positive electrodes 20 and a negative side of the rectifier 22 is connected to the current collecting bar 29 through a switch 25. The rectifier 22 supplies a direct current voltage of 200V. A positive side of a rectifier 23 serving as a high-voltage power source is connected to the second positive electrodes 21 and a negative side of the rectifier 23 is connected to the current collecting bar 30 through a switch 27 and also connected to the negative electrode 31 attached to an arm 12*a* of the robot 12 through a switch 26. The rectifier 23 supplies a direct current voltage of 300V.

Herein, the current collecting bar 29 corresponds to a first negative electrode, the current collecting bar 30 corresponds to a second negative electrode, and the negative electrode 31 corresponds to a third negative electrode.

A negative side of the rectifier 22 is connected to one end of a thyristor switch 24. The negative side of the rectifier 23 is connected to the other end of the thyristor switch 24. Furthermore, the switches 25, 26, and 27 and the thyristor switch 24 are connected to a control device 32.

The work electrodeposition coating method to be achieved by use of the work electrodeposition coating device having the above configuration is now explained.

While a work is directly held by a robot arm or fixed to a bracket which is held by the robot arm, the work is conveyed.

An arm 11*a* of the robot 11 holds and lifts up the work placed outside the electrodeposition tank 16 and then immerses the work into the paint 17 in the electrodeposition tank 16. When the work is to be immersed in the paint 17, the work is immersed at an angle appropriate to a shape of the work so that the air adhered to the work is allowed to easily escape. In addition, if the work has such a shape as to make air escape difficult, in the process of immersing the work in the paint, the robot 11 oscillates the arm 11*a* to change the angle of the work and also vibrate the work for air escape.

The robot 11 puts the work on the first table 18. At this time, the work is connected to the current collecting bar 29. When the work is put on the first table 18, the control device 32 turns the switch 25 on to conduct the work to the negative side of the rectifier 22. Accordingly, current flows through the first positive electrodes 20, the paint 17, the work, and the current collecting bar 29 and thus the electrodeposition coating is performed.

After a predetermined time has elapsed, the robot 12 holds or grasps the work. At this time, the negative electrode 31 attached to an arm 12*a* of the robot 12 is conducted to the negative side electrode of the rectifier 23. Consequently, when the arm 12*a* of the robot 12 simply grasps or holds the work, a spark could occur in a case that an electric potential difference exists between the negative side of the rectifier 22 and the negative side of the rectifier 23. In the present embodiment, therefore, a little before the arm 12*a* of the robot 12 grasps the work, the control device 32 turns the thyristor switch 24 on to conduct each negative side of the rectifiers 22 and 23 to ground 28 to thereby eliminate the electric potential difference. This can prevent the spark from occurring when the arm 12*a* grasps the work. After the work is grasped, the control device 32 turns the switch 25 off to stop the conduction between the current collecting bar 29 and the negative side of the rectifier 22.

While the arm 12*a* of the robot 12 grasps the work, the work is conducting to the negative electrode 31. Accordingly, current flows through the first positive electrodes 20, the paint 17, the work, and the negative electrode 31 and thus the electrodeposition coating is performed. While the work grasped by the arm 12*a* of the robot 12 is moved from the first table 18 to the second table 19, the current flows through the second positive electrodes 21, the paint 17, the work, and the negative electrode 31, thereby performing the electrodeposition coating with the high voltage.

Since the robot 12 conveys the work while the work is subjected to the electrodeposition coating and the robot 12 can hold the work at an arbitrary position and an angle with respect to the first positive electrodes 20 and the second positive electrodes 21, the work can be evenly coated. Moreover, the work is oscillated with respect to the first positive electrodes 20 and the second positive electrodes 21, so that the efficiency of the electrodeposition coating is enhanced and the coating time is reduced.

The robot 12 puts the work on the second table 19. Thereby, the current collecting bar 30 is conducted to the work. Then, the control device 32 turns the switch 26 off and the switch 27 on. Accordingly, the connection of the negative side of the rectifier 23 is switched from the negative electrode 31 to the current collecting bar 30.

Subsequently, the current flows through the second positive electrodes 21, the paint 17, the work, and the current collecting bar 30, thus the electrodeposition coating with the high voltage is performed.

After a predetermined time has elapsed, the control device 32 turns the switch 27 off to stop the electrodeposition coating. An arm 13*a* of the robot 13 then holds or grasps the work to take the work out of the paint 17. At this time, particles such as iron powder are floating on a surface of the paint 17. If the work is simply taken out of the paint, the particles may adhere to the work. However, the robot 13 that conveys the work can carry the work out of the paint at an arbitrary angle. As a result, the work can be carried out while being positioned in an appropriate orientation that does not allow the particles to adhere to the coated surface of the work, thus preventing the particles from adhering to the coated surface of the work.

As explained above in detail, the work electrodeposition coating method of the present embodiment is to perform the electrodeposition coating on a work surface by immersing the work in the paint 17 in the electrodeposition tank 16 provided with the first positive electrodes 20 for supplying the low voltage and the second positive electrodes 21 for supplying the high voltage. The electrodeposition coating method comprises: (a) a first step of causing the first robot 11 to move the work to the first table 18 provided with the current collecting bar 29 corresponding to the first positive electrodes 20; (b) a second step of connecting the work to the current collecting bar 29 and supplying the low voltage to the work to perform the electrodeposition coating; (c) a third step of switching the connection condition of the negative electrode 31 connected to the work from the current collecting bar 29 to the current collecting bar 30 corresponding to the second positive electrodes 21 when the second robot 12 including the negative electrode 31 chucks the work, and subsequently moving the work to the second table 19 provided with the current collecting bar 30 while performing the electrodeposition coating; and (d) a fourth step of connecting the work to the current collecting bar 30 and supplying the high voltage to the work to perform the electrodeposition coating. Therefore, when the work is immersed in the electrodeposition liquid, the work can be appropriately inclined, so that the air remains adhered to the lower surface of the work can be removed and thus uneven coating due to the air adhesion can be prevented. Moreover, the work can be retained in any positional relation to the first positive electrodes 20 and the second positive electrodes 21 and therefore each portion of the work can be evenly retained with respect to the positive electrodes for even coating. As a result, the thickness of the coating can be uniformized, resulting in the paint saving.

Furthermore, in the third step in which the connection condition of the negative electrode 31 is switched from the current collecting bar 29 to the current collecting bar 30 in the third step, the current collecting bar 29 and the current collecting bar 30 are brought into conduction by the thyristor switch 24. Therefore, the occurrence of a spark can be prevented even if an electric potential difference exists between the current collecting bar 29 and the current collecting bar 30.

Additionally, the work electrodeposition coating method further comprises a fifth step of causing the third robot 13 to disconnect the work from the current collecting bar 30 and convey the work. Therefore, all the conveyance of the work during the electrodeposition coating process is done by the robots, so that no additional conveyance means is needed, achieving the cost reduction in overall facilities.

The present invention is not limited to the above embodiment and may be embodied in other specific forms without departing from the essential characteristics thereof.

For instance, the present embodiment explains about the electrodeposition process in an electrodeposition system, but the invention may be applied to a degreasing process and a chemical conversion process.

The invention claimed is:

1. A work electrodeposition coating method of performing a electrodeposition coating on a work surface by immersing a work in an electrodeposition liquid in an electrodeposition tank having a first positive electrode for supplying a low voltage and a second positive electrode for supplying a high voltage, the method comprising:

a first step of causing a first robot to move the work to a first table provided with a first negative electrode corresponding to the first positive electrode;

a second step of connecting the work to the first negative electrode and supplying the low voltage to the work to perform the electrodeposition coating;

a third step of, when a second robot including a third negative electrode chucks the work, switching a connection condition of the third negative electrode connected to the work from the first negative electrode to a second negative electrode corresponding to the second positive electrode, and subsequently moving the work to a second table provided with the second negative electrode while performing the electrodeposition coating; and a fourth step of connecting the work to the second negative electrode and supplying the high voltage to perform the electrodeposition coating.

2. The work electrodeposition coating method according to claim 1, wherein the third step including causing a thyristor to bring the first negative electrode and the second negative electrode into conduction when the connection condition of the third negative electrode is to be switched from the first negative electrode to the second negative electrode.

3. The work electrodeposition coating method according to claim 1, comprising a fifth step of causing a third robot to disconnect the work from the second negative electrode and convey the work.

4. A work electrodeposition coating device for performing an electrodeposition coating on a work surface by immersing a work in an electrodeposition liquid in an electrodeposition tank provided with a first positive electrode for supplying a low voltage and a second positive electrode for supplying a high voltage, the device including:

a first table on which the work is to be connected to a first negative electrode corresponding to the first positive electrode and supplied with the low voltage for performing the electrodeposition coating;

a first robot for placing the work on the first table;

a second robot provided with a third negative electrode and configured such that a connection condition of the third negative electrode connected to the work is switched from the first negative electrode to the second negative electrode corresponding to the second positive electrode when the second robot chucks the work, and subsequently the second robot moves the work to a second table provided with the second negative electrode while performing the electrodeposition coating;

the second table for allowing the work to be connected to the second negative electrode and supplied with the high voltage for performing the electrodeposition coating; and a third robot for disconnecting the work from the second negative electrode and conveying the work.

* * * * *